US010499707B2

(12) United States Patent
Hobson et al.

(10) Patent No.: US 10,499,707 B2
(45) Date of Patent: Dec. 10, 2019

(54) ARTICLES OF FOOTWEAR HAVING A LENO WOVEN UPPER WITH A BLADDER COMPONENT

(71) Applicant: REEBOK INTERNATIONAL LIMITED, London (GB)

(72) Inventors: Dan Hobson, Waltham, MA (US); Matt Costa, Canton, MA (US); Thomas Piacentini, Waltham, MA (US)

(73) Assignee: Reebok International Limited, London (GB)

( * ) Notice: Subject to any disclaimer, the term of this patent is extended or adjusted under 35 U.S.C. 154(b) by 129 days.

(21) Appl. No.: 15/787,178

(22) Filed: Oct. 18, 2017

(65) Prior Publication Data

US 2019/0110557 A1 Apr. 18, 2019

(51) Int. Cl.

| | |
|---|---|
| ***A43B 1/04*** | (2006.01) |
| ***A43B 23/02*** | (2006.01) |
| ***D03D 19/00*** | (2006.01) |
| ***A43B 1/02*** | (2006.01) |
| ***D03D 15/08*** | (2006.01) |

(52) U.S. Cl.

CPC ..... *A43B 23/029* (2013.01); *A43B 1/02* (2013.01); *A43B 23/0205* (2013.01); *A43B 23/027* (2013.01); *D03D 15/08* (2013.01); *D03D 19/00* (2013.01); *D10B 2331/04* (2013.01); *D10B 2331/10* (2013.01); *D10B 2401/061* (2013.01); *D10B 2501/043* (2013.01)

(58) Field of Classification Search

CPC .... A43B 1/02; A43B 1/04; A43B 1/00; A43B 23/0205; A43B 23/0235; A43B 23/029

USPC ..... 36/45, 88, 93, 29

See application file for complete search history.

(56) References Cited

U.S. PATENT DOCUMENTS

| | | | | |
|---|---|---|---|---|
| 2,069,295 | A | 2/1937 | Wilson | |
| 2,147,197 | A | 2/1939 | Glidden | |
| 2,314,098 | A | 3/1943 | McDonald | |
| 2,500,668 | A | 3/1950 | Duckoff | |
| 3,524,792 | A | 8/1970 | Dawes | |
| 3,788,366 | A * | 1/1974 | Campbell, Sr. ..... | A41F 9/02 139/419 |
| 3,822,727 | A | 7/1974 | Small et al. | |

(Continued)

FOREIGN PATENT DOCUMENTS

| | | |
|---|---|---|
| CN | 101324001 | 7/2008 |
| CN | 103451769 | 12/2013 |

(Continued)

OTHER PUBLICATIONS

Extended European Search Report issued in European Patent Application No. 16176607.6 dated Dec. 9, 2016, 12 pages.

(Continued)

*Primary Examiner* — Marie D Bays

(74) *Attorney, Agent, or Firm* — Sterne, Kessler, Goldstein & Fox P.L.L.C.

(57) ABSTRACT

An article of footwear includes a sole, an upper, and an inflatable bladder disposed on the upper. The upper includes a leno woven fabric having a continuous leno weave pattern of a plurality of warp yarns extending in a longitudinal direction and a plurality of weft yarns extending in a transverse direction. The weft yarns include an elastic material.

23 Claims, 17 Drawing Sheets

(56) References Cited

U.S. PATENT DOCUMENTS 3,842,438 A * 10/1974 Campbell, Sr. ..... A41F 9/02 116/217
3,965,944 A * 6/1976 Goff, Jr. ..... D03D 15/08 139/421
4,144,727 A 3/1979 Duhl et al.
4,736,531 A 4/1988 Richard
4,785,558 A 11/1988 Shiomura
4,995,173 A 2/1991 Spier
5,074,765 A 12/1991 Pekar
5,113,599 A 5/1992 Cohen et al.
5,131,434 A 7/1992 Krummheuer et al.
5,158,767 A 10/1992 Cohen et al.
5,187,005 A 2/1993 Stahle et al.
5,253,435 A 10/1993 Auger et al.
5,257,470 A 11/1993 Auger et al.
5,343,638 A * 9/1994 Legassie ..... A43B 3/0005 36/28
5,345,638 A 9/1994 Nishida
5,351,710 A 10/1994 Phillips
5,372,487 A 12/1994 Pekar
5,384,973 A 1/1995 Lyden
5,416,988 A 5/1995 Potter et al.
5,430,961 A 7/1995 Faulconer et al.
5,435,230 A 7/1995 Phillips
5,444,926 A 8/1995 Allen et al.
5,480,287 A 1/1996 Pozzebon et al.
5,484,646 A 1/1996 Mann
5,562,967 A 10/1996 Kikuchi et al.
5,588,227 A 12/1996 Goldston et al.
5,765,298 A 6/1998 Potter et al.
5,987,779 A 11/1999 Litchfield et al.
6,004,891 A 12/1999 Tuppin et al.
6,029,376 A 2/2000 Cass
6,145,430 A 11/2000 Able et al.
6,189,172 B1 2/2001 Baek
6,237,251 B1 * 5/2001 Litchfield ..... A43B 1/0072 36/114
D447,637 S 9/2001 Lacy et al.
6,409,486 B1 6/2002 Baek
6,435,221 B1 * 8/2002 Waldrop ..... D03D 15/08 139/383 R
6,557,274 B2 * 5/2003 Litchfield ..... A43B 1/0072 36/29
D477,918 S 8/2003 Bruner et al.
D477,919 S 8/2003 Bruner et al.
6,684,911 B2 2/2004 Salway et al.
6,786,242 B2 9/2004 Salway et al.
6,931,762 B1 8/2005 Dua
7,047,668 B2 5/2006 Burris et al.
7,107,235 B2 9/2006 Lyden
D531,817 S 11/2006 Bruner et al.
7,166,349 B2 1/2007 Collins
7,254,908 B2 8/2007 Ungari
D557,509 S 12/2007 Davis et al.
7,395,617 B2 7/2008 Christensen et al.
7,478,488 B1 1/2009 Davis et al.
7,546,696 B1 6/2009 Acheson et al.
7,622,014 B2 11/2009 Millette et al.
7,721,575 B2 5/2010 Yokoyama
7,766,053 B2 8/2010 Barratte
7,823,298 B2 11/2010 Nishiwaki et al.
7,841,107 B2 11/2010 Braynock et al.
7,950,676 B2 5/2011 Goldsmith et al.
D664,365 S 7/2012 Whittle et al.
D664,366 S 7/2012 Whittle et al.
D664,367 S 7/2012 Whittle et al.
D664,368 S 7/2012 Davis
8,209,883 B2 7/2012 Lyden
8,375,471 B2 2/2013 Surve
8,540,838 B2 9/2013 Millette et al.
8,572,786 B2 11/2013 Davis et al.
8,578,632 B2 11/2013 Bell et al.
8,661,714 B2 3/2014 Sussmann
8,677,652 B2 3/2014 Marvin et al.
8,839,824 B2 9/2014 Cross et al.
8,910,313 B2 12/2014 Gorden et al.
8,925,129 B2 1/2015 Dojan et al.
9,526,293 B2 12/2016 Bell et al.
9,687,045 B2 6/2017 Leary et al.
9,756,901 B2 9/2017 Mush et al.
10,051,919 B2 * 8/2018 Leary ..... A43B 23/029
2001/0032399 A1 10/2001 Litchfield et al.
2002/0029493 A1 3/2002 Baek
2002/0098759 A1 * 7/2002 Salway ..... D03D 9/00 442/200
2002/0178610 A1 * 12/2002 Cheng ..... A43B 1/04 36/3 A
2003/0069807 A1 4/2003 Lyden
2003/0089000 A1 5/2003 Tseng
2003/0172983 A1 9/2003 Salway et al.
2004/0003515 A1 1/2004 Marvin et al.
2004/0003517 A1 1/2004 Marvin et al.
2004/0033337 A1 2/2004 Collins
2005/0028404 A1 2/2005 Marvin et al.
2005/0097779 A1 5/2005 Fang et al.
2005/0116379 A1 6/2005 Goldsmith et al.
2006/0048415 A1 3/2006 Marvin et al.
2006/0112593 A1 6/2006 Marvin et al.
2006/0130369 A1 6/2006 Christensen
2007/0000605 A1 1/2007 Millette et al.
2009/0099497 A1 * 4/2009 Jung ..... A61F 13/00038 602/76
2009/0119948 A1 5/2009 Ortley et al.
2009/0291603 A1 11/2009 Newton et al.
2010/0223808 A1 9/2010 Sandy
2011/0119963 A1 5/2011 Braynock et al.
2011/0192052 A1 8/2011 Quagliotto et al.
2011/0258881 A1 10/2011 Mateo
2011/0308115 A1 12/2011 Le et al.
2012/0084999 A1 4/2012 Davis et al.
2012/0167413 A1 7/2012 Marvin et al.
2013/0025157 A1 1/2013 Wan et al.
2013/0048140 A1 2/2013 Yenici et al.
2013/0055590 A1 3/2013 Mokos
2013/0190917 A1 7/2013 Cross et al.
2013/0219750 A1 8/2013 Dojan et al.
2013/0227857 A1 9/2013 Schindler et al.
2014/0053968 A1 2/2014 Millette et al.
2014/0059890 A1 3/2014 Davis et al.
2014/0157627 A1 6/2014 Smaldone et al.
2014/0173932 A1 6/2014 Bell
2014/0173933 A1 6/2014 Bell
2014/0173934 A1 6/2014 Bell
2014/0189964 A1 7/2014 Wen et al.
2014/0202042 A1 7/2014 Berend et al.
2014/0223771 A1 8/2014 Berend et al.
2014/0259760 A1 9/2014 Dojan et al.
2014/0273700 A1 9/2014 Mouhassin et al.
2014/0310983 A1 10/2014 Tamm et al.
2014/0310984 A1 10/2014 Tamm et al.
2014/0338222 A1 * 11/2014 Song ..... A43B 23/0235 36/45
2015/0013187 A1 1/2015 Taniguchi et al.
2015/0113831 A1 4/2015 Weingart et al.
2015/0201707 A1 7/2015 Bruce
2015/0208762 A1 7/2015 Reinhardt et al.
2015/0218737 A1 8/2015 Blakely
2015/0257476 A1 9/2015 Panian et al.
2015/0351488 A1 12/2015 Davis et al.
2016/0058100 A1 3/2016 Dealey et al.
2016/0081417 A1 3/2016 Podhajny
2016/0095377 A1 4/2016 Tamm
2016/0309843 A1 10/2016 Song et al.
2017/0006965 A1 * 1/2017 Musho ..... A43B 7/06
2017/0360155 A1 * 12/2017 Leary ..... A43B 23/029

FOREIGN PATENT DOCUMENTS

CN 203482955 U 3/2014
DE 10307489 B3 11/2004
DE 102013214598 A1 1/2015
EP 0600331 A1 6/1994

(56) References Cited

FOREIGN PATENT DOCUMENTS

| | | | |
|---|---|---|---|
| JP | H6113905 | | 4/1994 |
| KR | 10-1557130 | B1 | 9/2015 |
| TW | D122133 | | 4/2008 |
| TW | D125241 | | 10/2008 |
| TW | D138821 | | 2/2011 |
| TW | D141585 | | 7/2011 |
| TW | D141586 | | 7/2011 |
| WO | WO-96-000512 | | 1/1996 |
| WO | WO-98-043506 | | 3/1998 |
| WO | WO-2013-071679 | | 5/2013 |
| WO | WO-2013-103363 | | 7/2013 |
| WO | WO 2016171304 | A1 | 10/2016 |

OTHER PUBLICATIONS

Shinn et al., W.E. et al. "Leno Weaving and Design" Sep. 1930, 6 pages.
U.S. Appl. No. 95/002,094, filed Aug. 21, 2012.
U.S. Appl. No. 15/184,718, filed Jun. 16, 2016.

* cited by examiner

ARTICLES OF FOOTWEAR HAVING A LENO WOVEN UPPER WITH A BLADDER COMPONENT

FIELD

The described embodiments generally relate to articles of footwear having an upper including a leno woven fabric. More specifically, the described embodiments relate to articles of footwear having a leno woven upper with a bladder component.

BACKGROUND

Individuals are often concerned with the comfort and fit of an article of footwear. An upper of the article of footwear may function to secure the article of footwear to the wearer's foot. Characteristics of the upper, such as durability, weight, and breathability, may contribute to the comfort and fit of the footwear. Because these and other desired upper characteristics may conflict with each other, a continuing need exists for innovations in footwear, including in the fabrics and other components used to manufacture an upper.

BRIEF SUMMARY

Articles of footwear with a leno woven upper and a bladder component are disclosed. In some embodiments, an article of footwear includes a sole, an upper including a leno woven fabric having a continuous leno weave pattern of a plurality of warp yarns extending in a longitudinal direction and a plurality of weft yarns extending in a transverse direction, and an inflatable bladder disposed on the upper. In some embodiments, the weft yarns include an elastic material.

In some embodiments, the weft yarns include spandex. In some embodiments, the weft yarns include spandex with polyester.

In some embodiments, a weft yarn extends from the sole on a lateral side of the article of footwear to the sole on a medial side of the article of footwear. In some embodiments, a warp yarn extends from the sole to a collar of the upper. In some embodiments, a warp yarn extends from the sole to a heel counter of the upper.

In some embodiments, the inflatable bladder is disposed on an exterior surface of the upper. In some embodiments, the inflatable bladder extends from a heel region on a lateral side of the article of footwear across a throat of the article of footwear to a heel region on a medial side of the article of footwear.

In some embodiments, an upper for an article of footwear includes a leno woven fabric including a continuous leno weave pattern and an inflatable bladder disposed only on the leno woven fabric. In some embodiments, the leno woven fabric extends across the entire length of the upper. In some embodiments, the leno woven fabric extends across the entire width of the upper.

In some embodiments, the inflatable bladder is disposed on an outside of the leno woven fabric. In some embodiments, the inflatable bladder is disposed on an underside of the leno woven fabric.

In some embodiments, the leno woven fabric includes a single layer that forms a portion of an exterior surface of the upper and a portion of an interior surface of the upper. In some embodiments, the leno woven fabric includes an outermost layer of the upper and an innermost layer of the upper.

In some embodiments, the inflatable bladder is adhered to the leno woven fabric with an adhesive. In some embodiments, the adhesive is a hot melt adhesive.

In some embodiments, an article of footwear includes a sole, an upper including a leno woven fabric having a continuous leno weave pattern, and an inflatable bladder disposed only on the leno woven fabric. In some embodiments, the leno woven fabric includes an outermost layer of the upper and an innermost layer of the upper. In some embodiments, the leno woven fabric includes an elastic material.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION

Figure 1:
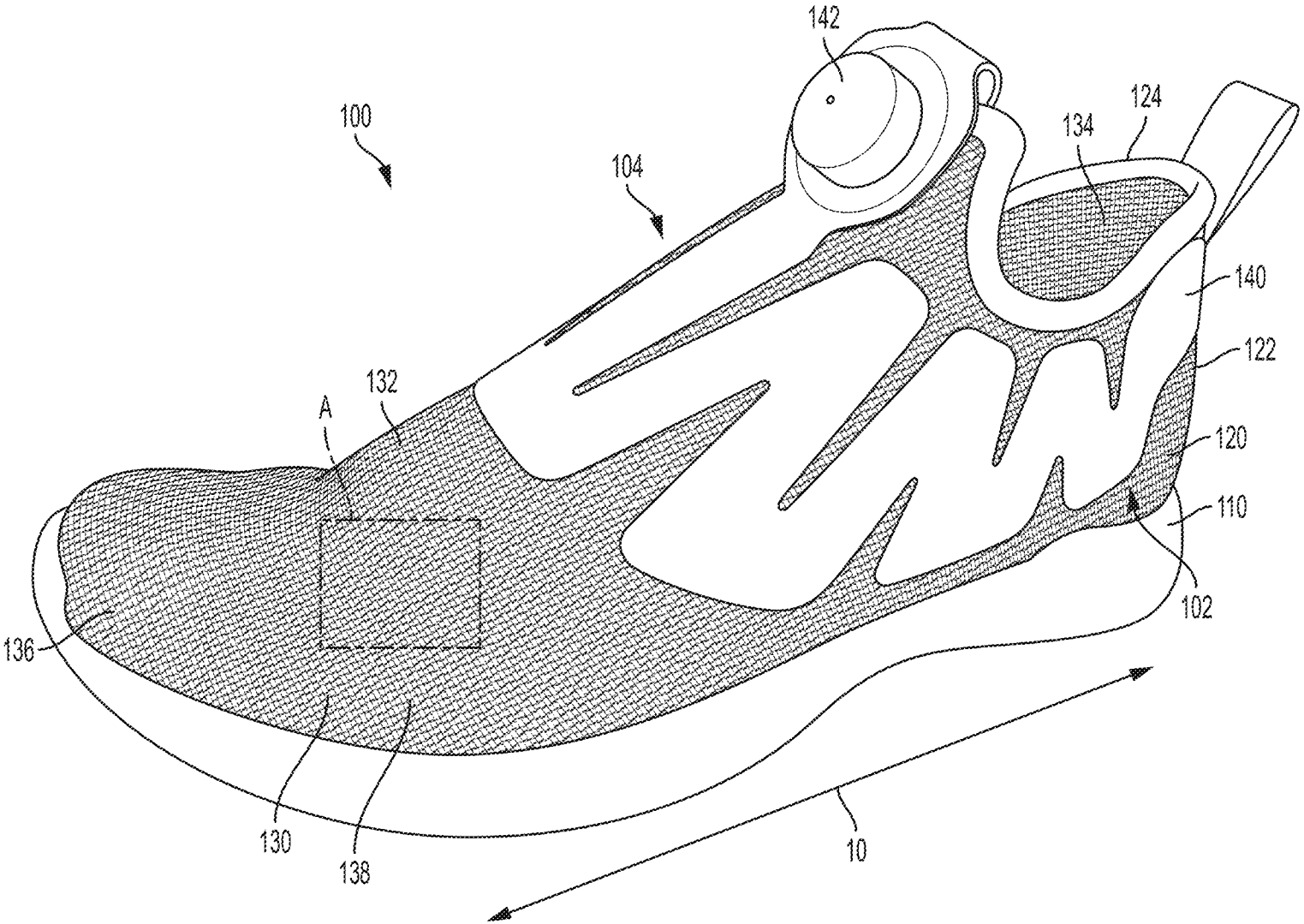
FIG. 1 shows a perspective view of an article of footwear according to some embodiments.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

The following examples are illustrative, but not limiting, of the present invention. Other suitable modifications and adaptations of the variety of conditions and parameters normally encountered in the field, and which would be apparent to those skilled in the art, are within the spirit and scope of the invention.

An article of footwear has many purposes. Among other things, an article of footwear may serve to provide cushioning for a wearer's foot, support a wearer's foot, and protect a wearer's foot. Each of these purposes, alone or in combination, provides for a comfortable article of footwear suitable for use in a variety of scenarios (e.g., exercise and every day activities). The features of an article of footwear (e.g., shape and materials used to make footwear) may be altered to produce desired characteristics, for example, comfort and fit.

Embodiments of the present invention provide articles of footwear having a highly breathable upper comprising a fabric with a leno weave (i.e., a leno woven fabric) and a component, such as an inflatable bladder, that together provide a comfortable and secure fit around the wearer's foot. In some embodiments, the leno woven fabric may form the entire (or substantially the entire) exterior and/or interior surface of the upper. In some embodiments, the upper may comprise a single layer leno woven fabric. In some embodiments, an inflatable bladder component is coupled to the leno woven fabric. The leno woven fabric and the inflatable bladder may be configured to provide desired characteristics of the upper. For example, a leno weave construction facilitates breathability of the upper while maintaining structural integrity by the weaving of weft yarns and warp yarns in the leno weave. At the same time, the inflatable bladder, when inflated, may operate to provide additional cushioning to the wearer's foot and/or to cinch down the upper to ensure the wearer's foot is securely fitted within the upper. In some embodiments, the leno woven fabric may be constructed to further facilitate the effect of the inflatable bladder. For example, the weft yarns and/or the warp yarns may be elastic to allow portions of the upper to stretch as the bladder is inflated. In some embodiments, the amount of stretch can control the amount of movement of the inflatable bladder in certain directions. In some embodiments, the amount of stretch may hold the inflatable bladder closer to the wearer's foot.

Figure 2:
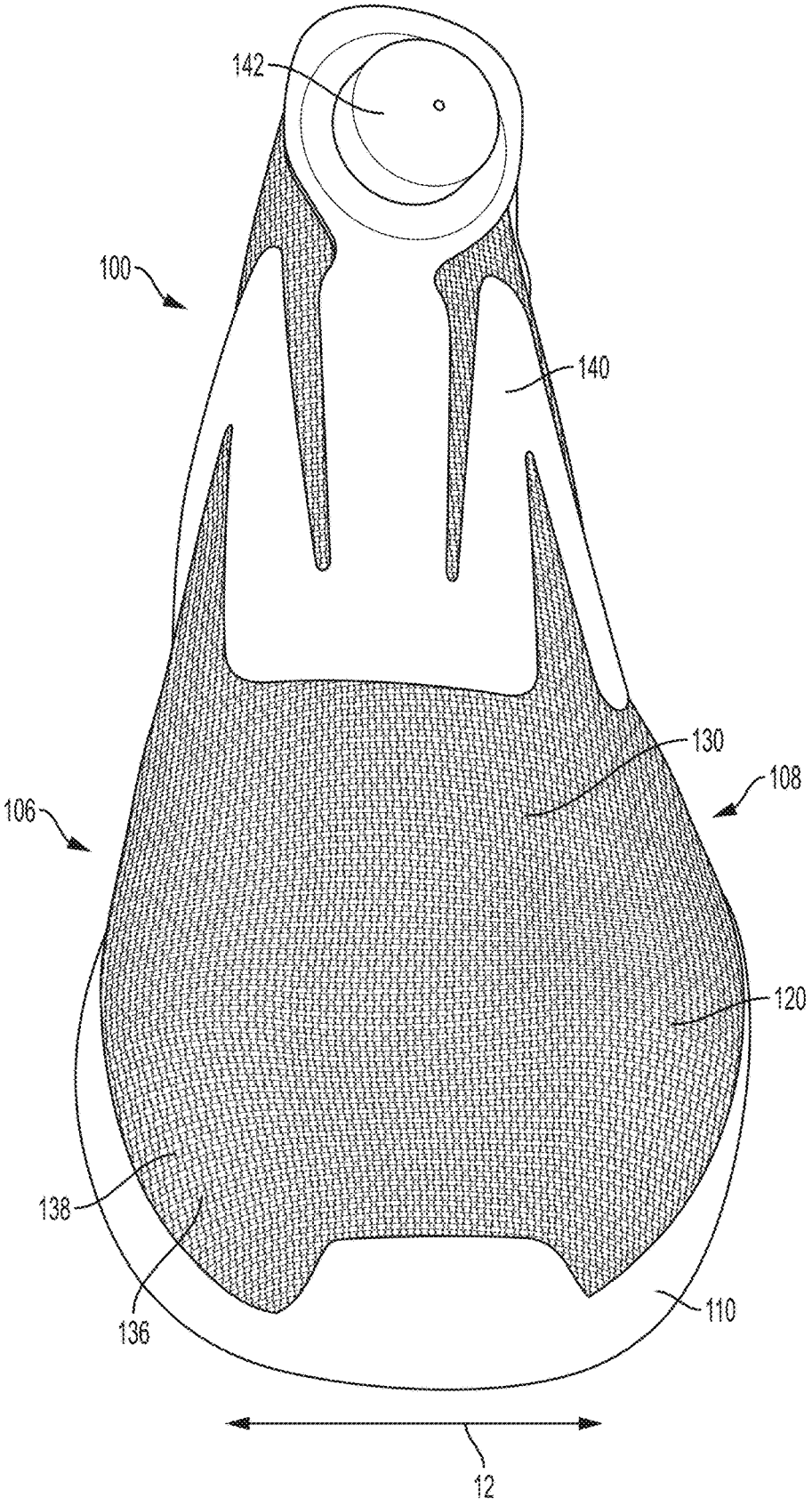
FIG. 2 shows a front view of an article of footwear according to some embodiments.

In some embodiments, an article of footwear 100, as shown, for example, in FIGS. 1 and 2, includes a sole 110 and an upper 120 coupled to sole 110. In some embodiments, upper 120 comprises a leno woven fabric 130 and an inflatable bladder 140. In some embodiments, upper 120 comprises a heel counter 122. Heel counter 122 may be disposed in a heel region 102 of upper 120 to provide additional support to a wearer's heel. In some embodiments, upper 120 comprises a collar 124. Collar 124 may surround an opening in upper 120 configured to receive a wearer's foot. Collar 124 may be a separate piece of material attached (e.g., sewed) to leno woven fabric 130 to provide a finished look to the edge of leno woven fabric 130. In some embodiments, leno woven fabric 130, inflatable bladder 140, heel counter 122, and collar 124, in addition to components that attach these parts (e.g., sewing thread, adhesive, etc.), form the entire upper 120. In some embodiments, upper 120 only includes leno woven fabric 130 and inflatable bladder 140 (including an inflation mechanism and a deflation mechanism). In some embodiments, upper 120 only includes leno woven fabric 130, inflatable bladder 140, and heel counter 122. In some embodiments, upper 120 also includes a bootie disposed interior of leno woven fabric 130 (i.e., separating a wearer's foot from leno woven fabric 130).

All or a portion of upper 120 may comprise leno woven fabric 130. In some embodiments, leno weave fabric 130 comprises a continuous leno weave pattern. In some embodiments, leno woven fabric 130 extends from the foremost part of upper 120 to the rearmost part of upper 120. Thus, leno woven fabric 130 may extend across the entire length of upper 120. In some embodiments, leno woven fabric 130 extends from sole 110 on a medial side 106 of article of footwear 100 to sole 110 on a lateral side 108 of article of footwear 100. Thus, leno woven fabric 130 may extend across the entire width of upper 120.

In some embodiments, leno woven fabric 130 may define at least 50% of upper 120. In embodiments including a single layer leno woven fabric 130, single layer woven fabric 130 may completely define at least 50% of upper 120. In other words, at least 50% of the composition of upper 120 may be defined by single layer leno woven fabric 130. In some embodiments, leno woven fabric 130 may occupy at least 50% of the outer surface area of upper 120.

In some embodiments, leno woven fabric 130 forms an outer surface 132 of upper 120. In some embodiments, leno woven fabric 130 forms the entire outer surface 132 of upper 120. In some embodiments, leno woven fabric 130 forms an inner surface 134 of upper 120. In some embodiments, leno woven fabric 130 forms the entire inner surface 134 of upper 120. In some embodiments, leno woven fabric 130 comprises an outermost layer of upper 120 and an innermost layer of upper 120. In some embodiments, leno woven fabric 130 is a single layer woven fabric. In some embodiments, leno woven fabric 130 comprises a single layer that forms all or a portion of an exterior surface of upper 120 (e.g., outer surface 132) and all or a portion of an interior surface of upper 120 (e.g., inner surface 134). In some embodiments, leno woven fabric 130 includes more than one layer.

In some embodiments, leno woven fabric 130 comprises a plurality of warp yarns 138 extending in a longitudinal direction 10 and a plurality of weft yarns 136 extending in a transverse direction 12 substantially perpendicular to warp yarns 138. As shown in FIGS. 1 and 2, longitudinal direction 10 runs along the length of article of footwear 100 and transverse direction 12 runs along the width of article of footwear 100. In some embodiments, weft yarns 136 may extend in longitudinal direction 10 and warp yarns 138 may extend in transverse direction 12.

In some embodiments, one or more of weft yarns 136 extend across the entire width of upper 120. In some embodiments, one or more of weft yarns 136 extend from sole 110 on medial side 106 of article of footwear 100 to sole 110 on lateral side 108 of article of footwear 100. In some embodiments, one or more of weft yarns 136 extend from sole 110 on medial side 106 of article of footwear 100 to collar 124. In some embodiments, one or more of weft yarns 136 extend from sole 110 on lateral side 108 of article of footwear 100 to collar 124.

In some embodiments, one or more warp yarns 138 extend across the entire length of upper 120. In some embodiments, one or more of warp yarns 138 extend from sole 110 to collar 124 in longitudinal direction 10. In some embodiments, one or more of warp yarns 138 extend from sole 110 to heel counter 122 in longitudinal direction 10. In some embodiments, one or more of warp yarns 138 extend from the foremost part of upper 120 to collar 124 (e.g., along a throat region 104 of upper 120). Thus, in some embodiments, leno woven fabric 130 may have a continuous leno weave pattern of weft yarns 136 and warp yarns 138.

In some embodiments, leno woven fabric 130 comprises a stretch leno weave (i.e., a leno woven fabric that has stretch characteristics). In some embodiments, leno woven fabric 130 comprises a two-way stretch material. In some embodiments, leno woven fabric 130 provides a desired stretchability because of the weaving pattern. In some embodiments, leno woven fabric 130 provides a desired stretchability because of the material of weft yarns 136 and/or warp yarns 138. In some embodiments, leno woven fabric 130 provides a desired stretchability because of a combination of the weaving pattern and the material of weft yarns 136 and/or warp yarns 138. In some embodiments, weft yarns 136 comprise an elastic material. In some embodiments, weft yarns 136 comprise spandex. In some embodiments, weft yarns 136 comprise polyester. In some embodiments, weft yarns 136 comprise spandex with polyester. In some embodiments, weft yarns 136 comprise a thermoplastic elastomer. In some embodiments, weft yarns 136 comprise a material that provides little to no stretch.

Figure 3:
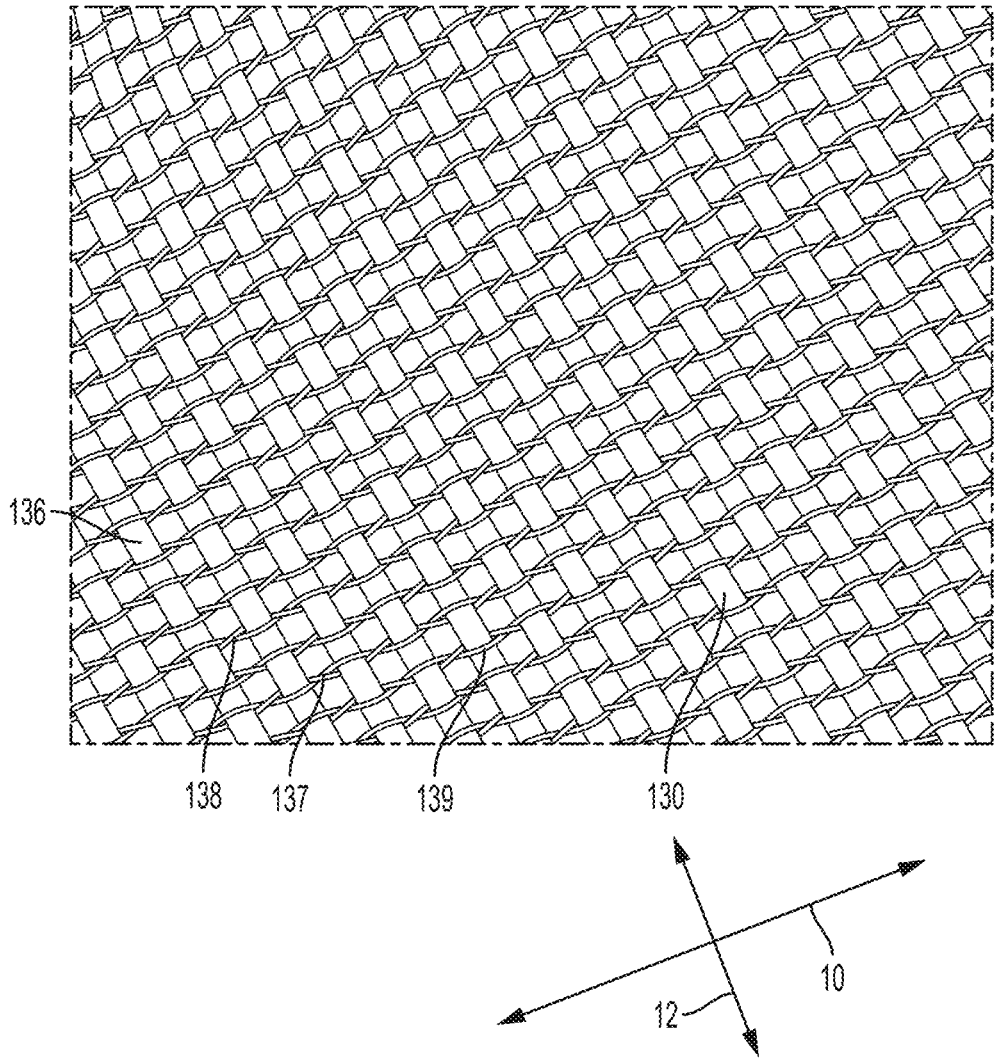
FIG. 3 shows a close-up view of portion A of the article of footwear in FIG. 1 according to some embodiments.

The weaving of warp yarns 138 in leno woven fabric 130 may form a plurality of twists 137 and a plurality of eyelets 139, as shown, for example, in FIG. 3. One or more weft yarns 136 may pass through eyelets 139 to form a leno weave configuration having a pattern. Twists 137 separate weft yarns 136 (or a plurality of weft yarns 136) in leno woven fabric 130. The location and configuration of twists 137 and eyelets 139 may influence the pattern of leno woven fabric 130, which may influence one or more characteristics of leno woven fabric 130. The number of weft yarns 136 woven through eyelets 139 at different locations on upper 120 may be employed to vary the pattern of leno woven fabric 130 and therefore the characteristics of leno woven fabric 130 at different locations on upper 120.

For example, various leno woven fabrics 200, 210, 220, 230, 240, 250, 260, 270, 280, and 290 with different patterns are shown in FIGS. 4-13. Any of leno woven fabrics 200, 210, 220, 230, 240, 250, 260, 270, 280, and 290, as well as other leno weaves, may be used in upper 120.

Figure 4:
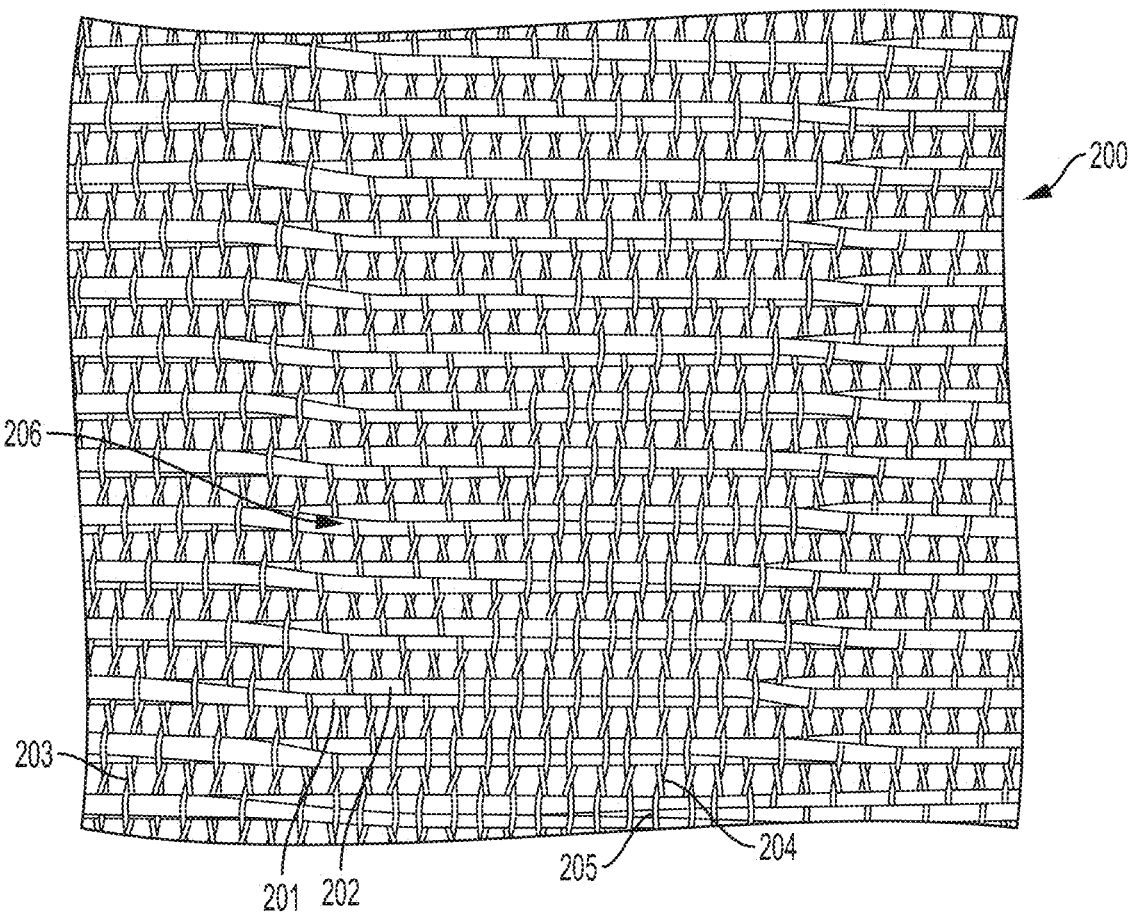
FIG. 4 shows a leno woven fabric according to some embodiments.

In some embodiments, leno woven fabric 200 comprises an engineered jacquard leno weave, as shown, for example, in FIG. 4. In some embodiments, leno woven fabric 200 comprises multiple layers of weft yarns. For example, leno woven fabric 200 may comprise a first layer 201 of weft yarns and a second layer 202 of weft yarns. In some embodiments, leno woven fabric 200 may comprise additional layers of weft yarns. In some embodiments, first layer 201 and second layer 202 of weft yarns are woven with warp yarns 203 in a typical leno weave configuration (i.e., with twists 204 and eyelets 205) in portions of leno woven fabric 200. In some embodiments, a portion of leno woven fabric 200 is woven with a jacquard configuration 206 in which warp yarn 203 goes over and under weft yarns 201, 202 without a twist. In some embodiments, jacquard configuration 206 may change the layering of weft yarns (e.g., moving second layer 202 above first layer 201, as shown in FIG. 4). The pattern provided by jacquard configuration 206 may contribute to desired characteristics of leno woven fabric 200 when used in upper 120.

Figure 5:
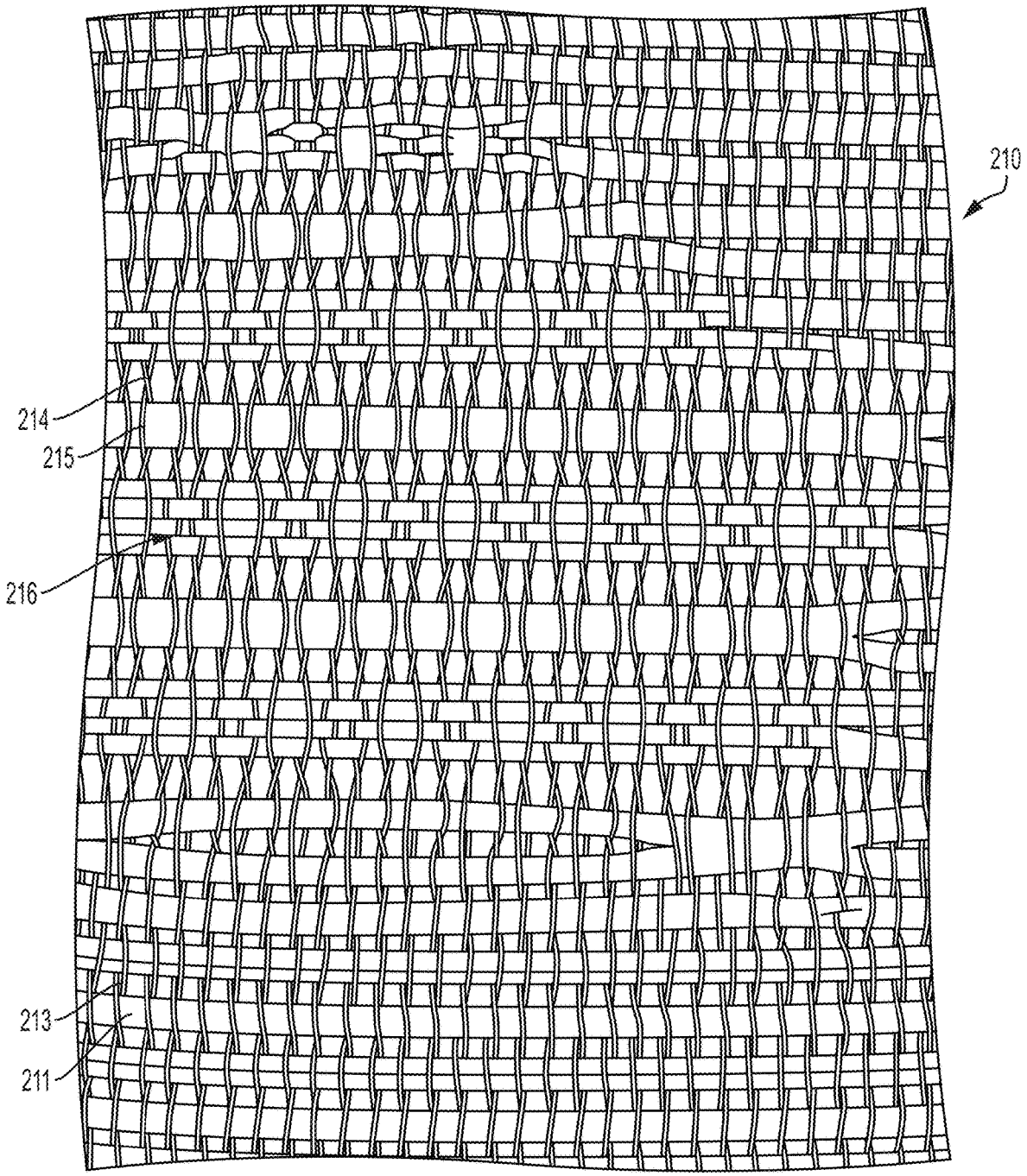
FIG. 5 shows a leno woven fabric according to some embodiments.
Figure 6:
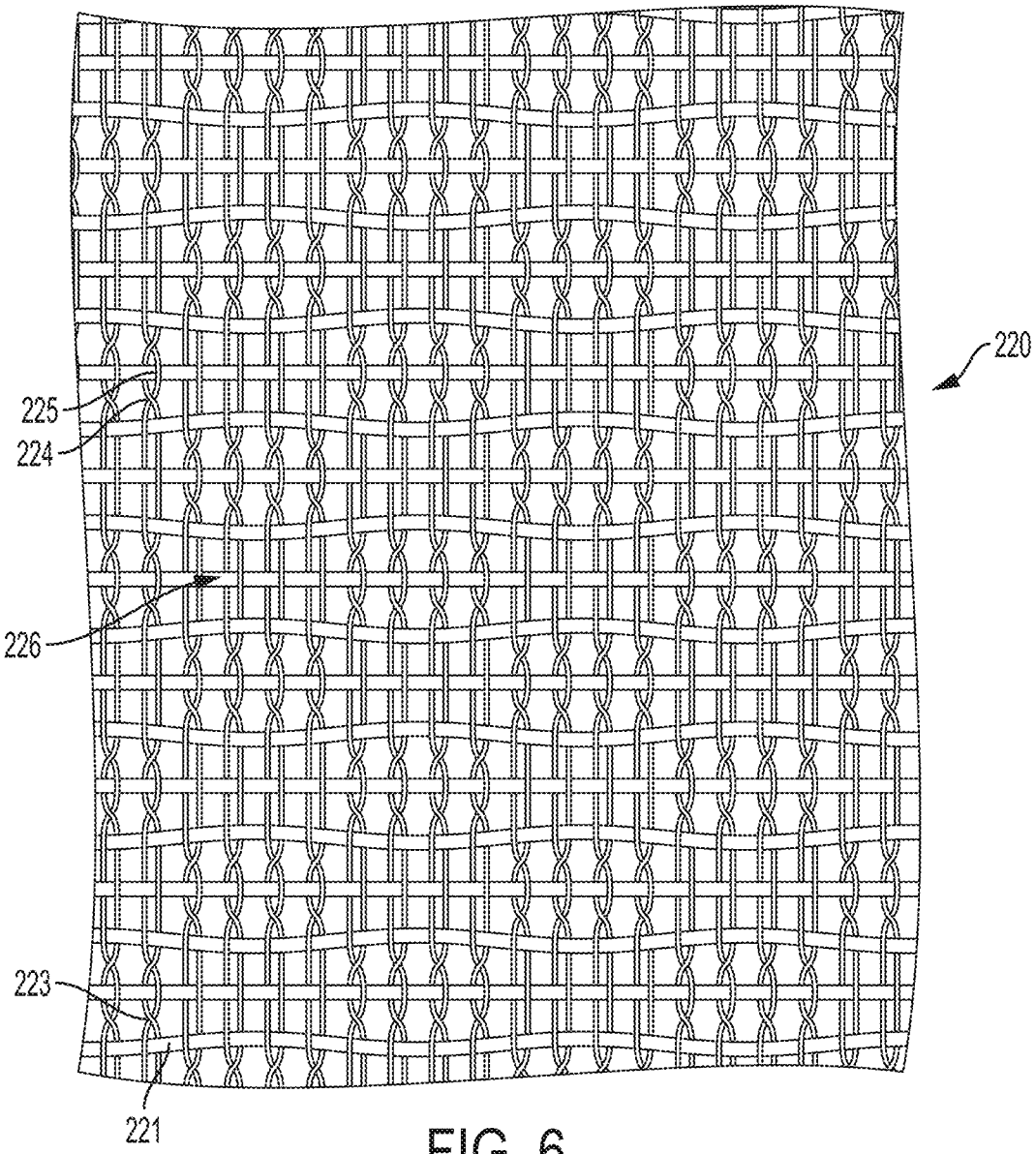
FIG. 6 shows a leno woven fabric according to some embodiments.
Figure 7:
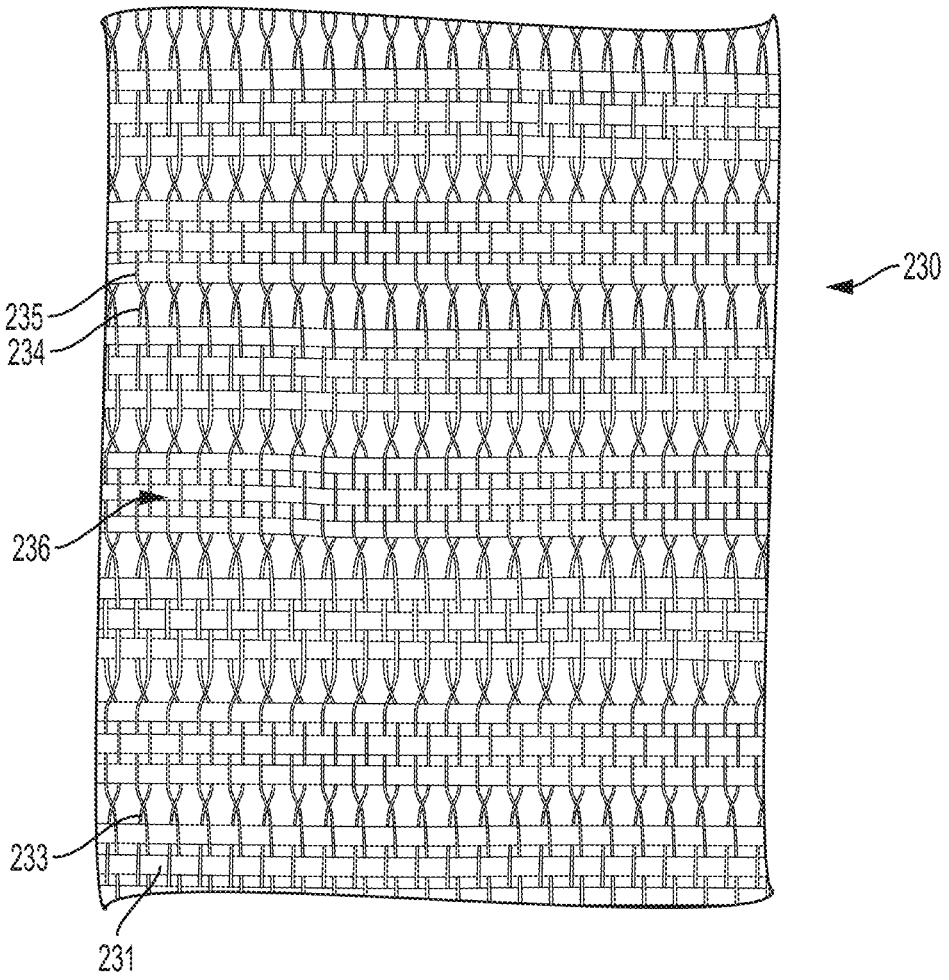
FIG. 7 shows a leno woven fabric according to some embodiments.
Figure 8:
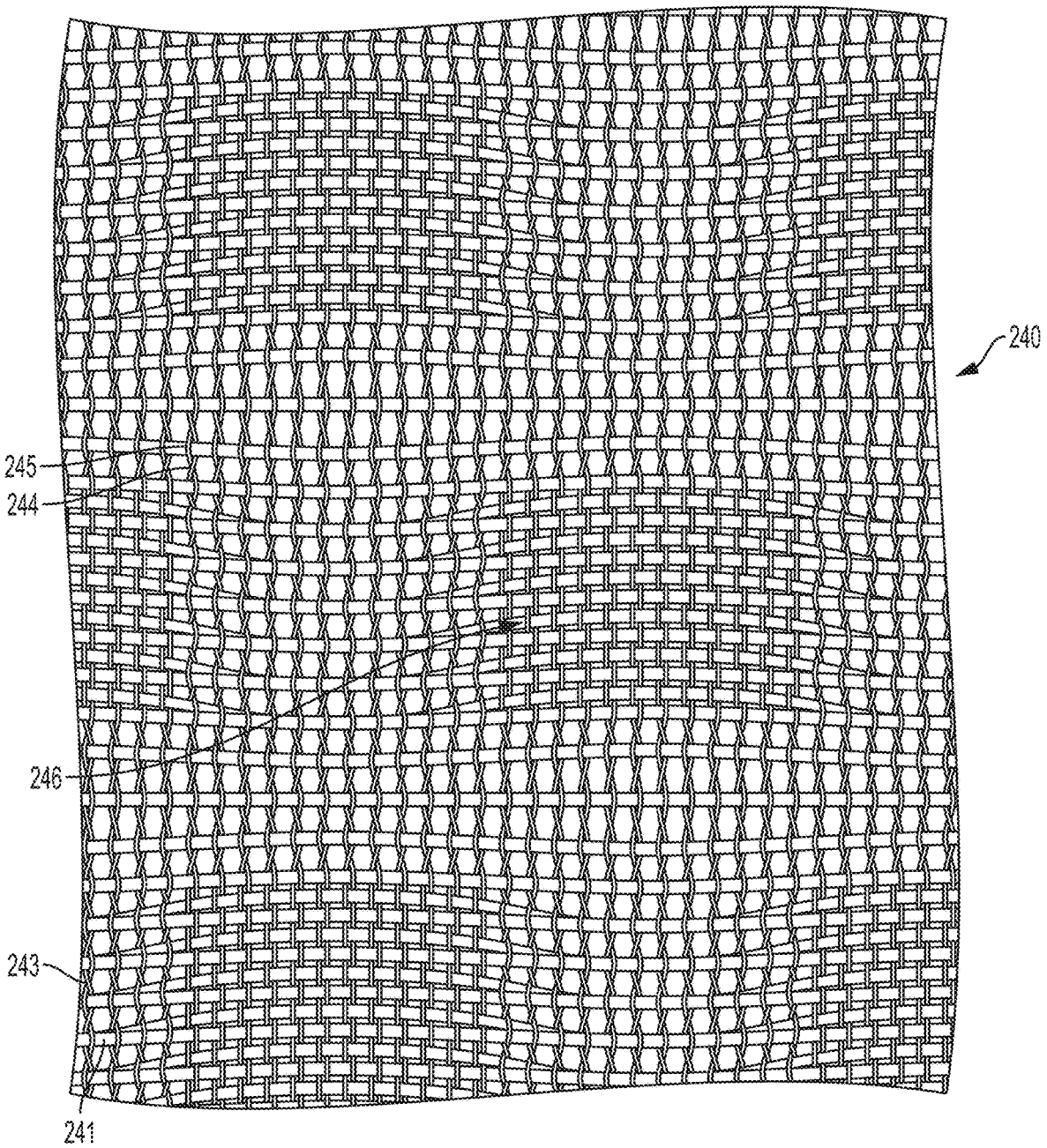
FIG. 8 shows a leno woven fabric according to some embodiments.
Figure 9:
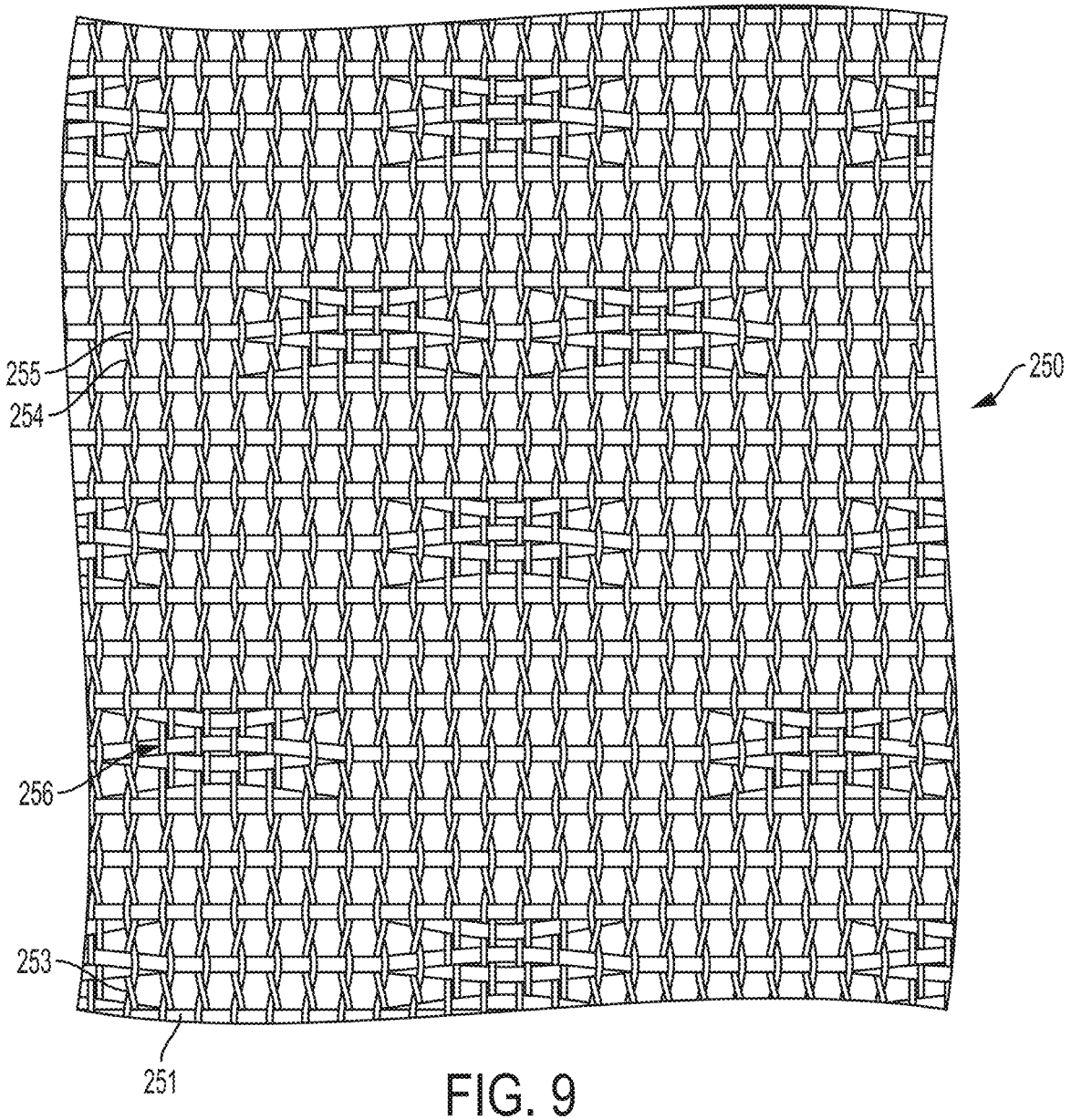
FIG. 9 shows a leno woven fabric according to some embodiments.

In some embodiments, leno woven fabric 210 comprises a custom jacquard leno weave, as shown, for example, in FIG. 5. In some embodiments, leno woven fabric 210 comprises weft yarns 211 and warp yarns 213 woven in a typical leno weave configuration (i.e., with twists 214 and eyelets 215) in portions of leno woven fabric 210. In some embodiments, a portion of leno woven fabric 210 is woven with a jacquard configuration 216 in which warp yarn 213 goes over and under weft yarn 211 without a twist. In some embodiments, the portion of leno woven fabric 210 woven with jacquard configuration 216 separates weft yarns 211 from each other to form non-repeating custom patterns, as shown, for example, in FIG. 5. The patterns provided by jacquard configurations 216 may contribute to desired characteristics of leno woven fabric 210 when used in upper 120.

In some embodiments, a leno woven fabric (e.g., leno woven fabrics 220, 230, 240, and 250) comprise a repeat jacquard leno weave, as shown, for example, in FIGS. 6-9. In some embodiments, leno woven fabrics 220, 230, 240, and 250 comprise weft yarns 221, 231, 241, and 251 (respectively) and warp yarns 223, 233, 243, and 253 (respectively) woven in a typical leno weave configuration (i.e., with twists 224, 234, 244, and 254 and eyelets 225, 235, 245, and 255) in portions of leno woven fabrics 220, 230, 240, and 250. In some embodiments, a portion of leno woven fabrics 220, 230, 240, and 250 is woven with a jacquard configuration 226, 236, 246, and 256 in which warp yarn 223, 233, 243, and 253 goes over and under weft yarn 221, 231, 241, and 251 without a twist. In some embodiments, the portion of leno woven fabrics 220, 230, 240, and 250 woven with jacquard configuration 226, 236, 246, and 256 separates weft yarns 221, 231, 241, and 251 from each other to form repeating patterns, as shown, for example, in FIGS. 6-9. The patterns provided by jacquard configurations 226, 236, 246, and 256 may contribute to desired characteristics of leno woven fabrics 220, 230, 240, and 250 when used in upper 120.

Figure 10:
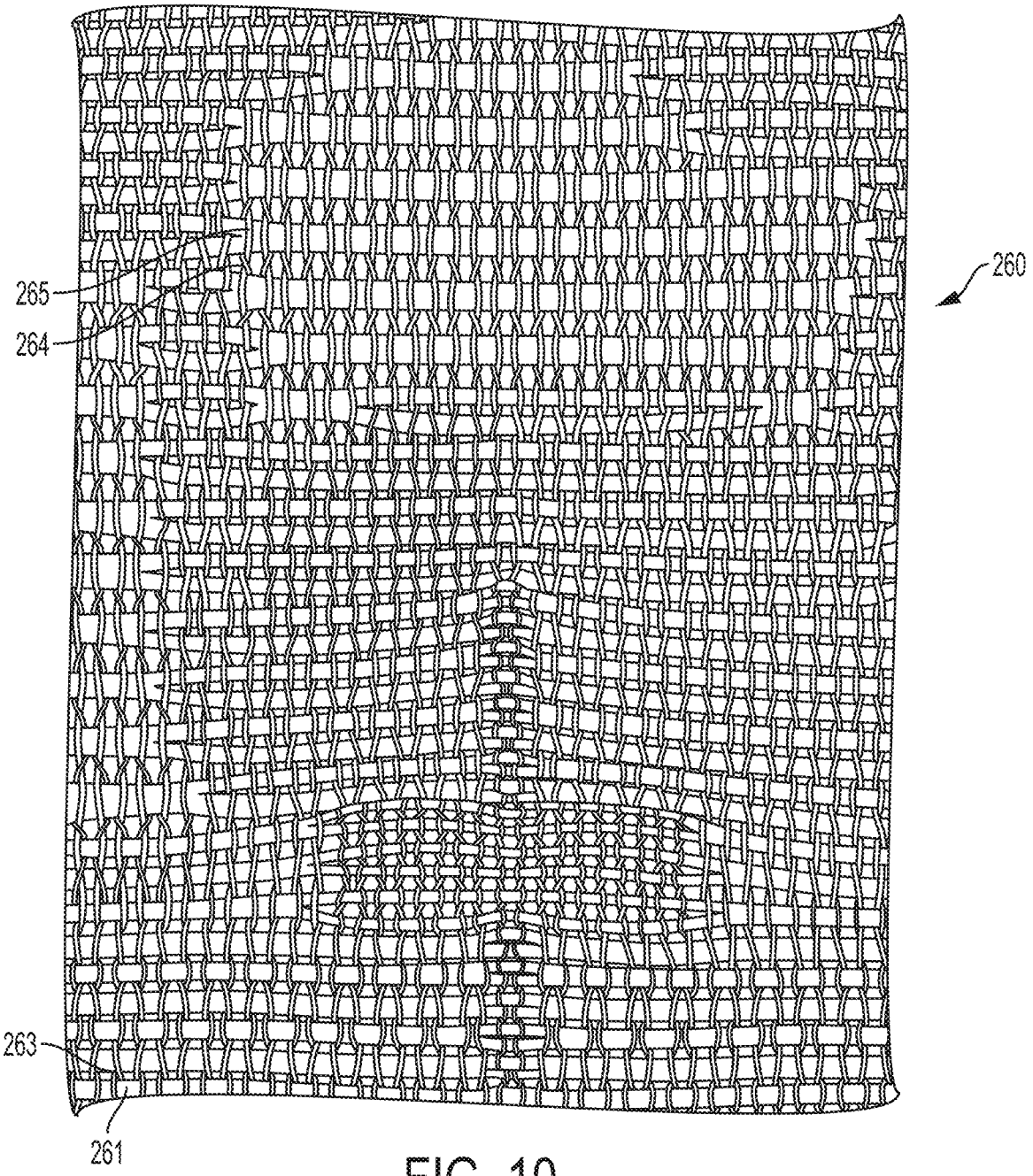
FIG. 10 shows a leno woven fabric according to some embodiments.

In some embodiments, leno woven fabric 260 comprises a custom leno weave, as shown, for example, in FIG. 10. In some embodiments, leno woven fabric 260 comprises weft yarns 261 and warp yarns 263 woven in a typical leno weave configuration (i.e., with twists 264 and eyelets 265) throughout leno woven fabric 260 (i.e., without any jacquard configuration). In some embodiments, twists 264 between each set of weft yarns 261 create a non-repeating custom pattern, as shown, for example, in FIG. 10. The pattern may contribute to desired characteristics of leno woven fabric 260 when used in upper 120.

Figure 11:
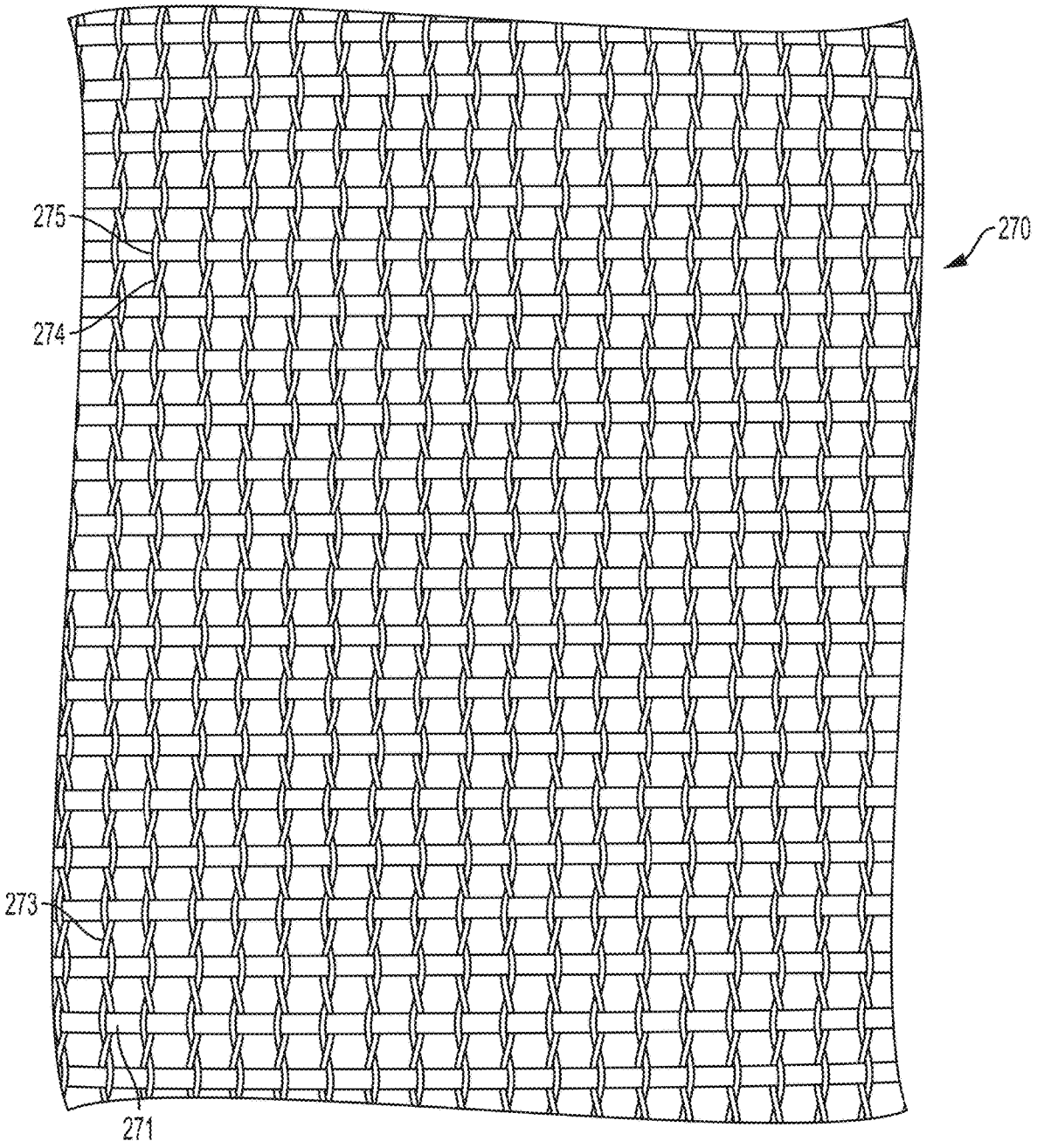
FIG. 11 shows a leno woven fabric according to some embodiments.
Figure 12:
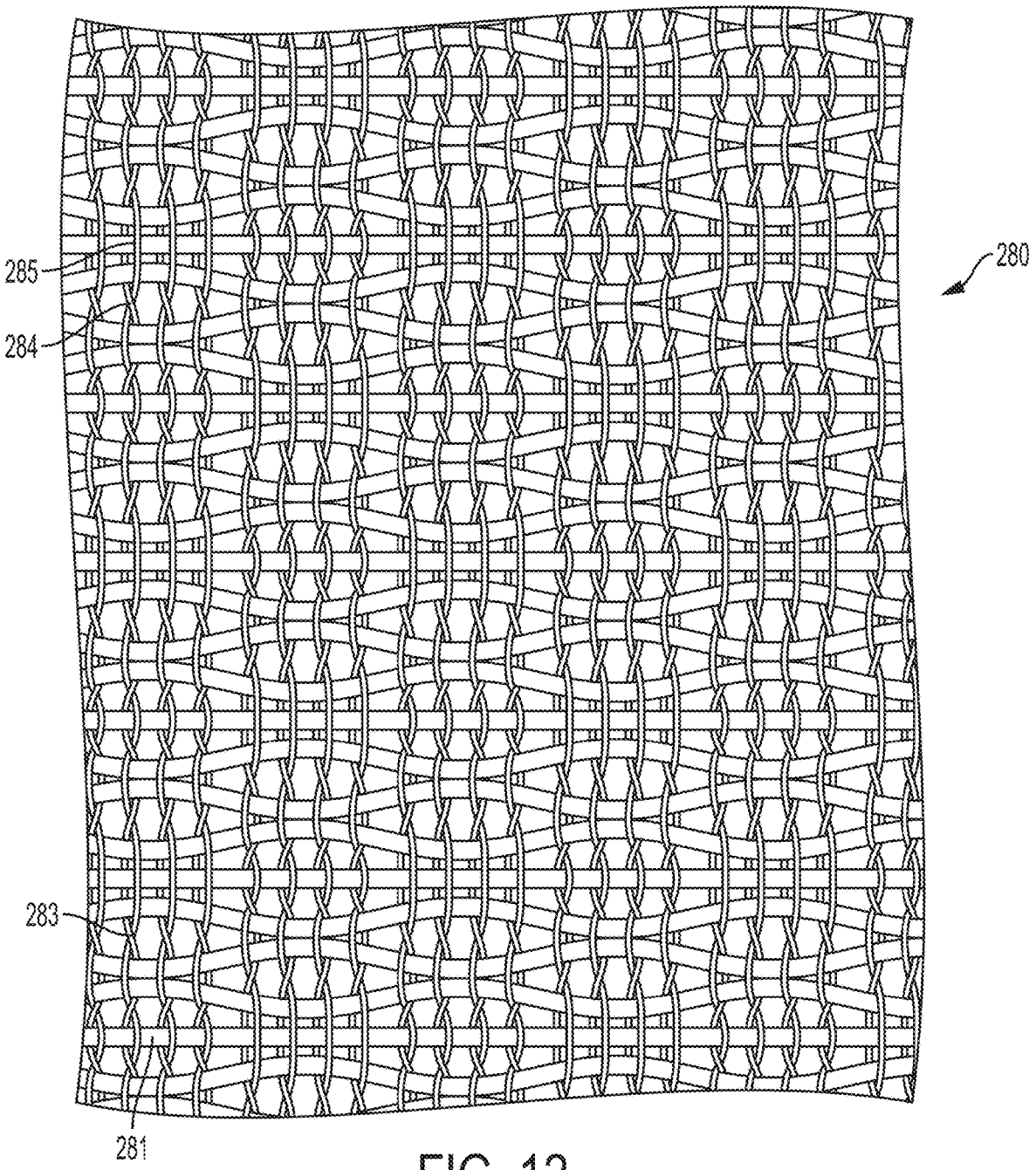
FIG. 12 shows a leno woven fabric according to some embodiments.
Figure 13:
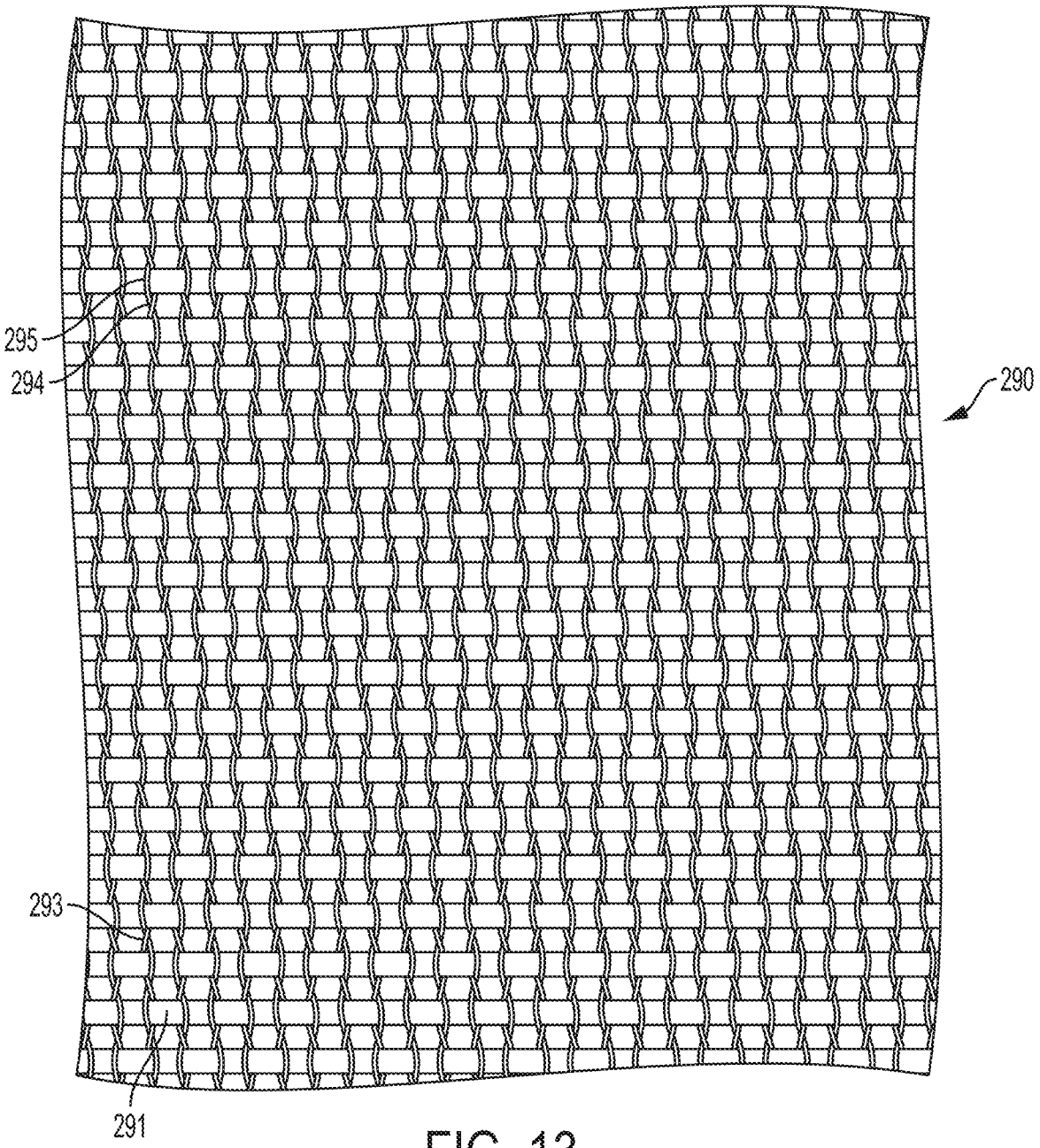
FIG. 13 shows a leno woven fabric according to some embodiments.

In some embodiments, a leno woven fabric (e.g., leno woven fabrics 270, 280, and 290) comprise a repeat leno weave, as shown, for example, in FIGS. 11-13. In some embodiments, leno woven fabrics 270, 280, and 290 comprise weft yarns 271, 281, and 291 (respectively) and warp yarns 273, 283, and 293 (respectively) woven in a typical leno weave configuration (i.e., with twists 274, 284, and 294 and eyelets 275, 285, and 295) throughout leno woven fabrics 270, 280, and 290 (i.e., without any jacquard configuration). In some embodiments, twists 274, 284, and 294 between each set of weft yarns 271, 281, and 291 create a repeating pattern, as shown, for example, in FIGS. 11-13. The patterns may contribute to desired characteristics of leno woven fabrics 270, 280, and 290 when used in upper 120.

In some embodiments, inflatable bladder 140 is disposed on upper 120. In some embodiments, inflatable bladder 140 is disposed only on leno woven fabric 130 (i.e., rather than being disposed on other components, such as heel counter 122). In some embodiments, inflatable bladder 140 is disposed both on leno woven fabric 130 and other components, such as heel counter 122. In some embodiments, inflatable bladder 140 is coupled to leno woven fabric 130, as shown, for example, in FIGS. 1 and 2. In some embodiments, inflatable bladder 140 is attached to the outer surface 132 (i.e., the exterior surface) of upper 120 formed by leno woven fabric 130. In some embodiments, inflatable bladder 140 is attached to the inner surface 134 of upper 120 formed by leno woven fabric 130.

Figure 15:
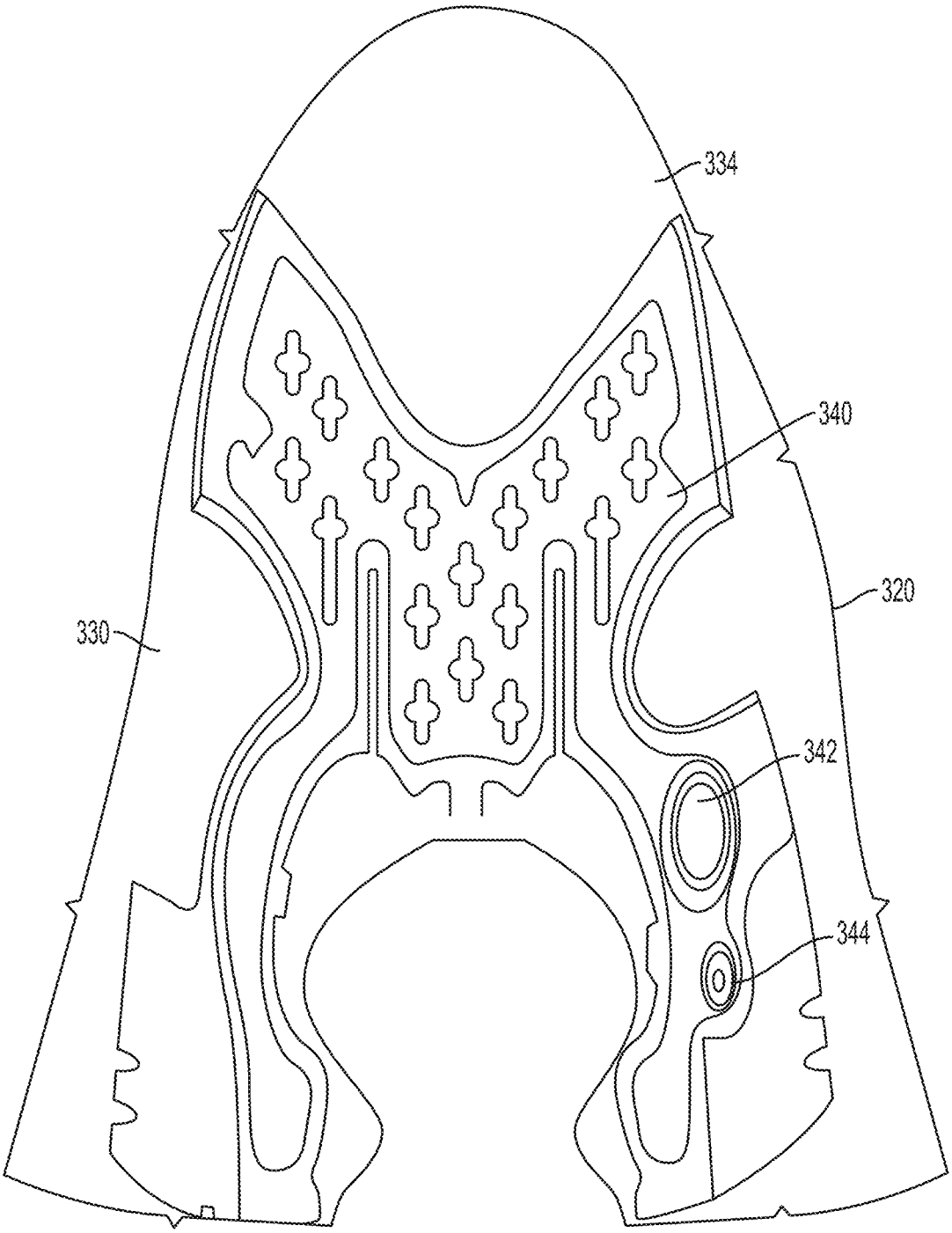
FIG. 15 shows a bladder on an upper layout for an article of footwear according to some embodiments.

Inflatable bladder 140 may be coupled to any portion of leno woven fabric 130. In some embodiments, inflatable bladder 140 extends from heel region 102 on lateral side 108 of article of footwear 100 across the throat 104 of article of footwear to heel region 102 on medial side 106 of article of footwear 100, as shown, for example, in FIGS. 1 and 2. In some embodiments, inflatable bladder 140 comprises a zig-zag pattern with segments of inflatable bladder 140 extending back and forth towards and away from collar 124. In some embodiments, inflatable bladder 140 nearly surrounds collar 124 (e.g., surrounds more than 75% of collar 124). This configuration contributes to article of footwear 100 securely fitting the wearer's foot because as inflatable bladder 140 inflates, inflatable bladder 140 cinches down around the wearer's foot. In some embodiments, leno woven fabric 130 that has stretch properties facilitates this cinching action. For example, in some embodiments, the amount of stretch can control the amount of movement of inflatable bladder 140 in certain directions. In some embodiments, weft yarns 136 and/or warp yarns 138 may be elastic to allow portions of upper 120 to stretch as inflatable bladder 140 is inflated. In some embodiments, the weave pattern of leno woven fabric 130 may contribute to the stretchability of various portions of upper 120. In some embodiments, a portion of leno woven fabric 130 has less stretch than another portion of leno woven fabric 130. In some embodiments, the portion of leno woven fabric 130 underneath inflatable bladder 140 may have less stretch than other portions of leno woven fabric 130. For example, as inflatable bladder 140 inflates, the portion of leno woven fabric 130 with less stretch keeps inflatable bladder 140 in place where cinching is desired while the portions with more stretch do not inhibit inflatable bladder 140 from cinching down. In some embodiments, the amount of stretch may hold inflatable bladder 140 closer to the wearer's foot. In some embodiments, upper 120 does not include securement means other than inflatable bladder 140 and leno woven fabric 130 with elastic (e.g., elastic weft yarns 136). Other configurations of inflatable bladders may also be used (see FIGS. 15 and 16).

In some embodiments, inflatable bladder 140 comprises an inflation mechanism 142. In some embodiments, inflation mechanism 142 comprises an on-board pump. Other types of inflation mechanisms may also be used. In some embodiments, inflatable bladder 140 comprises a deflation mechanism (e.g., deflation mechanisms 344 and 444 shown in FIGS. 15 and 16).

Figure 14:
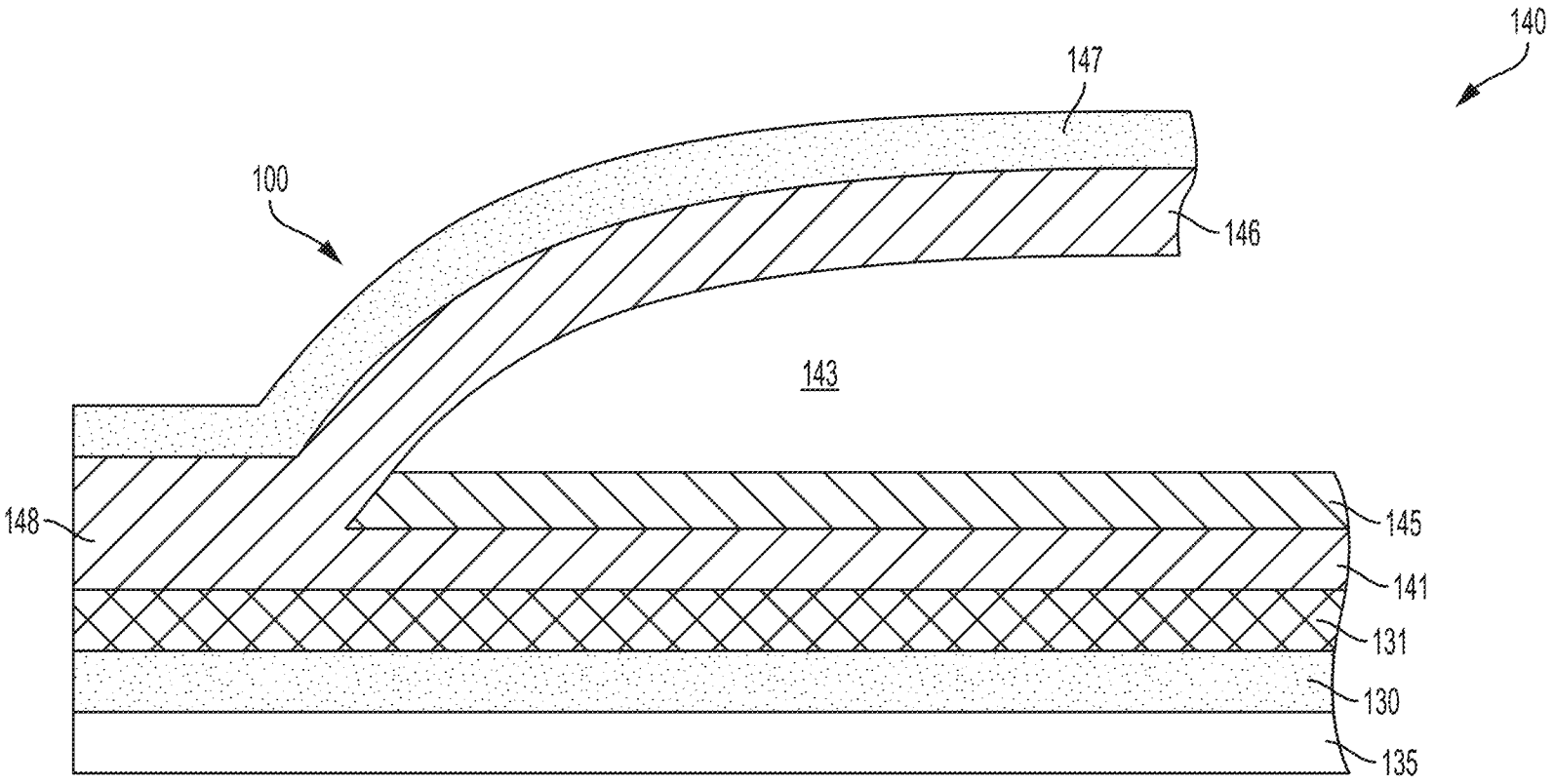
FIG. 14 shows a cross-sectional view of a bladder on an article of footwear according to some embodiments.

In some embodiments, inflatable bladder 140 is disposed on an outside of leno woven fabric 130 (i.e., outer surface 132 of upper 120). In some embodiments, inflatable bladder is disposed on an underside of leno woven fabric 130 (i.e., inner surface 134 of upper 120). In some embodiments, the outside of leno woven fabric 130 is opposite the underside of leno woven fabric 130. In some embodiments, the outside of leno woven fabric 130 is the outermost surface of upper 120. In some embodiments, the underside of leno woven fabric is the innermost surface of upper 120. In some embodiments, inflatable bladder 140 is disposed only on leno woven fabric 130. In some embodiments, inflatable bladder 140 is attached to leno woven fabric 130 by stitching, adhesive, bonding, heat sealing, or other suitable fastening means. For example, as shown in FIG. 14, inflatable bladder 140 may be attached to leno woven fabric 130 with an adhesive 131. In some embodiments, adhesive 131 may include, for example, an ethylene-vinyl acetate copolymer, a polyolefin, a polyamide, a polyester, a polyurethane, or other suitable adhesive. The adhesive may be a glue or a film (for example, a hot melt film made of TPU). In some embodiments, inflatable bladder 140 may be attached to the outermost layer of upper 120 (i.e., outer surface 132 of leno woven fabric 130) with an adhesive 131. In some embodiments, an additional layer of adhesive 135 is applied to an innermost layer of upper 120 (i.e., inner surface 134 of leno woven fabric 130), as shown in FIG. 14.

Any suitable type or shape of bladder suitable for footwear may be utilized within the scope of the present invention as inflatable bladder 140. In some embodiments, inflatable bladder 140 is a printed bladder as is described in commonly owned U.S. Pat. No. 8,572,786, entitled "Method for Manufacturing Inflatable Bladders for Use in Footwear and Other Articles of Manufacture," the disclosure of which is incorporated herein by reference thereto.

For example, according to some embodiments, inflatable bladder 140, as illustrated in FIG. 14, has a first film 141 and a second film 146. Disposed between first film 141 and second film 146 is a release agent 145. Release agent 145 may be disposed in a pattern that will correspond to a pattern of inflatable bladder 140 (e.g., a zig-zag pattern) formed by the following method.

According to some embodiments, release agent 145 is disposed on first film 141. Alternatively, release agent 145 may be disposed on both first film 141 and second film 146. First film 141 and second film 146 may be identical or different materials; but they must be each made from a material that may be adhered together to form a fluid-tight seal. Films can be formed from a variety of polymers such as thermoplastic resins, other elastomeric materials, thermoset materials, and composites thereof, including but not limited to, thermoplastic polyurethane (TPU), ethylenevinylacetate/polyethylene copolymer, polyester elastomer (e.g. Hytrel® material available from DuPont), polyethylene, polypropylene, neoprene, natural rubber, dacron/polyester, polyvinylchloride, thermoplastic rubbers, nitrile rubber, butyl rubber, sulfide rubber, methyl rubber, silicone rubber, polyvinyl acetate, Buna-N, Buna-S, polystyrene, ethylene propylene, polybutadiene, chlorfulfonated polythylene, nylon, partially set thermoset materials, ethylene vinyl acetate (EVA) foam, thermoset rubber, prepreg, and others.

Release agent 145 can be formed from a variety of materials, such as paint, ink, paper, textile, particulate, photosensitive agent, TEFLON®, silicone, plastic, acid, or any other material suitable for preventing first film 141 and second film 146 from adhering to each other where the release agent 145 has been disposed. In some embodiments, release agent 145 is cured to first film 141. For example, release agent 145 may be cured to first film 141 by the application of ultraviolet light. In some embodiments, release agent 145 may be silicone fortified.

After release agent 145 is applied to, disposed on, and/or cured to first film 141, first film 141 and second film 146 are bonded together by the application of heat and/or pressure. However, where release agent 145 is disposed between first film 141 and second film 146, there exists an inflatable compartment 143 with a peripheral edge 148. In some embodiments, this method may be used to create multiple inflatable compartments 143.

In other embodiments, alternative methods of creating inflatable bladder 140 may be used. In some embodiments, an additional layer 147 may be disposed on an outer surface of bladder 140. In some embodiments, additional layer 147 comprises a coating (e.g., a polyurethane coating).

The size, shape, and pattern of inflatable bladders may vary from shoe to shoe to accommodate various needs and preferences. For example, in some embodiments, an inflatable bladder 340 may be used, as shown, for example, in FIG. 15. In some embodiments, upper layout 320 is formed entirely or partially from leno woven fabric 330. Leno woven fabric 330 may have any of the characteristics of other leno woven fabrics described herein. In some embodiments, inflatable bladder 340 is attached to an underside, such as inner surface 334, of upper layout 320. In some embodiments, inflatable bladder 340 includes an inflation mechanism 342 and a deflation mechanism 344.

Figure 16:
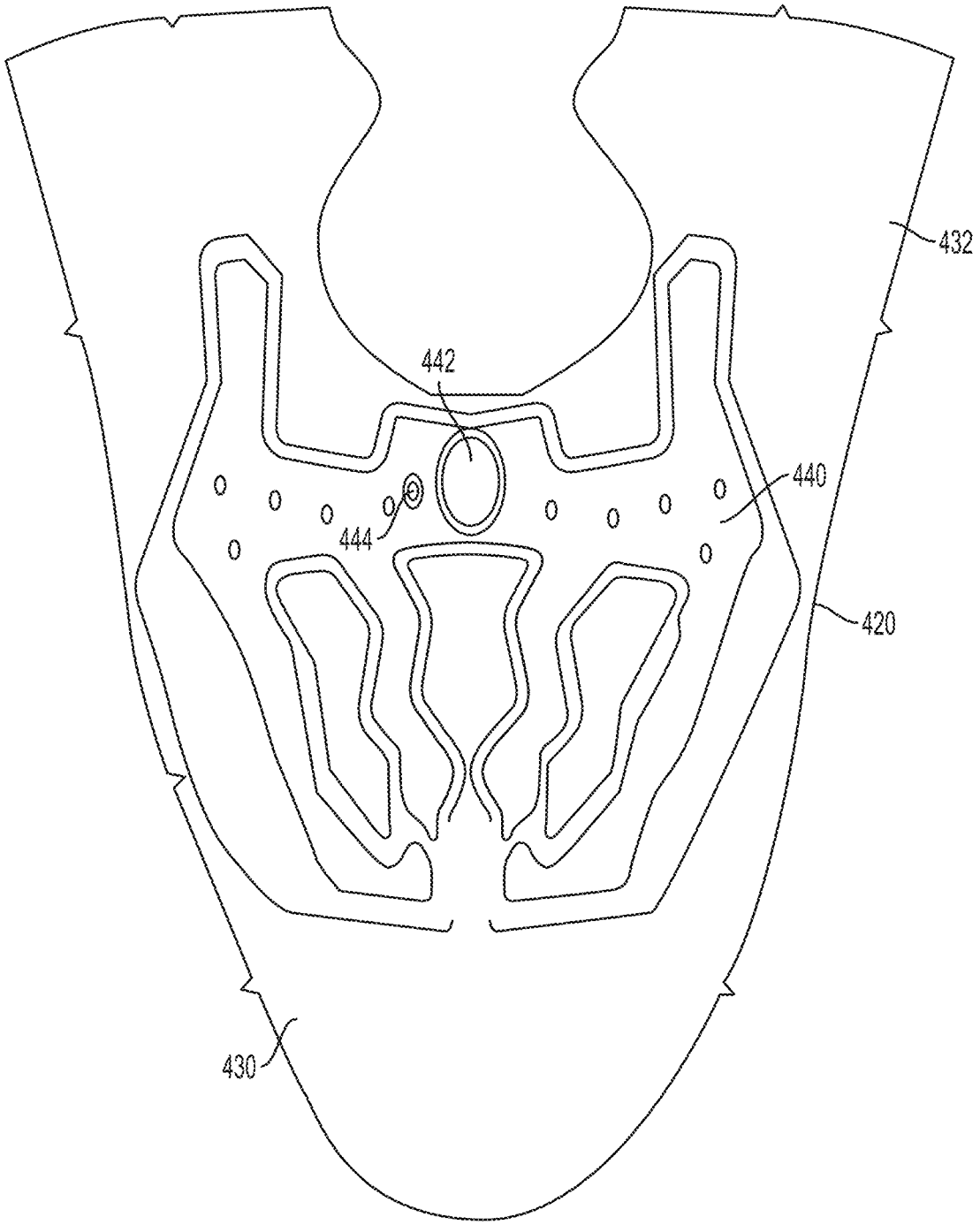
FIG. 16 shows a bladder on an upper layout for an article of footwear according to some embodiments.

As an additional example, in some embodiments, inflatable bladder 440 may be used, as shown, for example, in FIG. 16. In some embodiments, upper layout 420 is formed entirely or partially from leno woven fabric 430. Leno woven fabric 430 may have any of the characteristics of other leno woven fabrics described herein. In some embodiments, inflatable bladder 440 is attached to an outside, such as outer surface 432, of upper layout 420. In some embodiments, inflatable bladder 440 includes an inflation mechanism 442 and a deflation mechanism 444.

Figure 17:
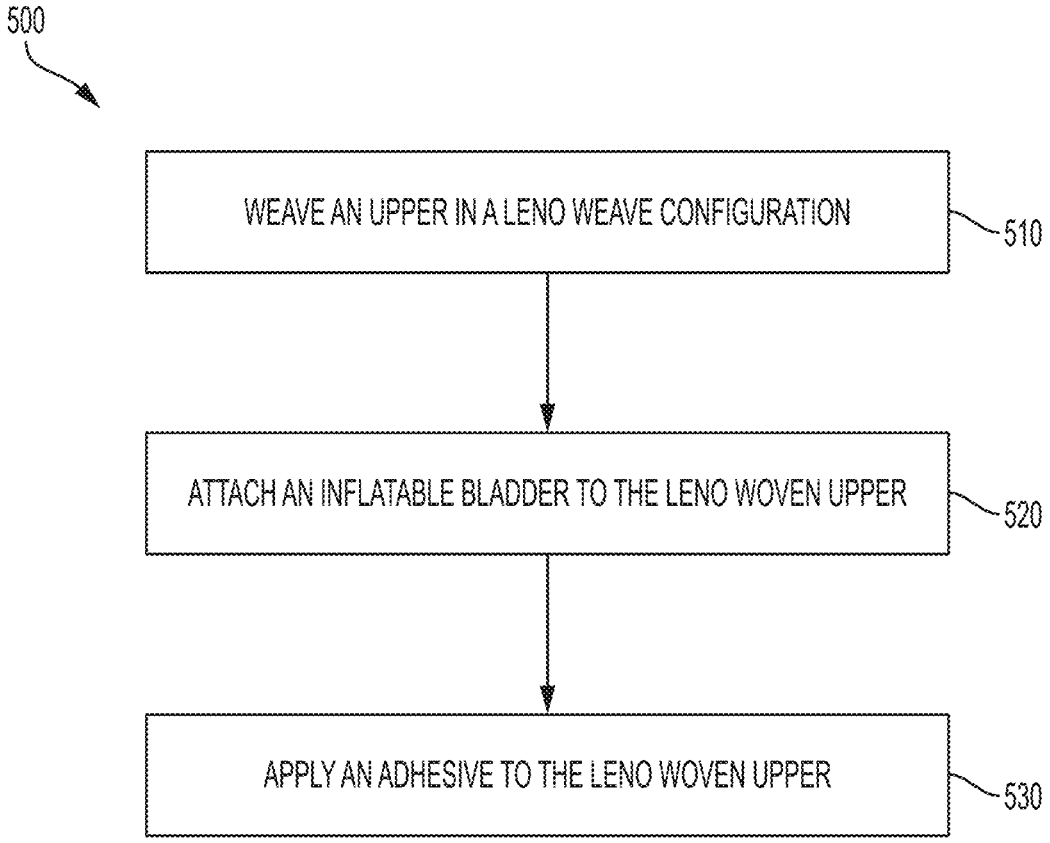
FIG. 17 shows a method for making an article of footwear according to some embodiments.

A method 500 for making an upper (e.g., upper 120) is shown, for example, in FIG. 17. In some embodiments, at operation 510, an upper is woven in a leno weave configuration. In some embodiments, the leno weave configuration may be an engineered jacquard leno weave (see FIG. 4), a custom jacquard leno weave (see FIG. 5), a repeat jacquard leno weave (see FIGS. 6-9), a custom leno weave (see FIG. 10), a repeat leno weave (see FIGS. 11-13), or a combination thereof. In some embodiments, the leno weave configuration includes a plurality of warp yarns extending in a longitudinal direction (e.g., longitudinal direction 10) and a plurality of weft yarns extending in a transverse direction (e.g., transverse direction 12).

In some embodiments, at operation 520, an inflatable bladder (e.g., inflatable bladder 140) is attached to an outside surface of the leno woven upper. In some embodiments, the inflatable bladder is attached to the outside surface of the leno woven upper by adhering the inflatable bladder with a hot melt adhesive to the outside surface of the leno woven upper. In some embodiments, the leno woven upper may be pre-shrunk. In some embodiments, pre-shrinking the leno woven upper results in a more consistent final shape of the leno woven upper. In some embodiments, the leno woven upper is pre-shrunk before a hot melt adhesive is applied.

In some embodiments, at operation 530, an adhesive is applied to the leno woven upper. In some embodiments, the adhesive is applied to an inside surface of the leno woven upper.

Various embodiments described herein allow for articles of footwear that provide a comfortable and secure fit around the wearer's foot. Further variations of the embodiments described above may also be provided. For example, the location and shape of inflatable bladders is not limited to the inflatable bladders shown in FIGS. 1, 2, 15, and 16. Moreover, variations in the material, direction, and patterns of the warp and weft yarns may be utilized in some embodiments. For example, while weft yarns have primarily been disclosed as extending in the transverse direction, in some embodiments, the weft yarns may extend in the longitudinal direction. Similarly, while warp yarns have primarily been disclosed as extending in the longitudinal direction, in some embodiments, the warp yarns may extend in the transverse direction. In some embodiments, warp yarns may extend in the longitudinal direction and weft yarns may extend in the transverse direction in one portion of the upper while warp yarns may extend in the transverse direction and weft yarns may extend in the longitudinal direction in another portion of the upper. Other variations are also possible.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An article of footwear comprising:

a sole;

an upper comprising a leno woven fabric having a continuous leno weave pattern of a plurality of warp yarns extending in a longitudinal direction and a plurality of weft yarns extending in a transverse direction, wherein the leno woven fabric comprises a first portion and a second portion; and an inflatable bladder disposed on the upper, wherein the inflatable bladder is disposed on the first portion of the leno woven fabric, wherein the weft yarns comprise an elastic material, wherein the first portion of the leno woven fabric comprises a first leno weave pattern comprising a first degree of stretchability, and the second portion of the leno woven fabric comprises a second leno weave pattern comprising a second degree of stretchability greater than the first degree of stretchability.

2. The article of footwear of claim 1, wherein the weft yarns comprise spandex.

3. The article of footwear of claim 1, wherein the weft yarns comprise spandex with polyester.

4. The article of footwear of claim 1, wherein a weft yarn extends from the sole on a lateral side of the article of footwear to the sole on a medial side of the article of footwear.

5. The article of footwear of claim 1, wherein the upper comprises an opening configured to receive a wearer's foot and a collar surrounding the opening, and the plurality of warp yarns includes a warp yarn extending from the sole to the collar of the upper.

6. The article of footwear of claim 1, wherein the upper comprises a heel counter configured to support a wearer's heel, and the plurality of warp yarns includes a warp yarn extending from the sole to the heel counter of the upper.

7. The article of footwear of claim 1, wherein the inflatable bladder is disposed on an exterior surface of the upper.

8. The article of footwear of claim 1, further comprises:

a lateral side and a medial side;

a heel region and a throat region, wherein the inflatable bladder extends from the heel region on the lateral side of the article of footwear across the throat region of the article of footwear to the heel region on the medial side of the article of footwear.

9. The article of footwear of claim 1, wherein an arrangement of the warp yarns and weft yarns along the first leno weave pattern varies from an arrangement of the warp yarns and weft yarns along the second leno weave pattern.

10. An upper for an article of footwear, the upper comprising:

a leno woven fabric comprising a continuous leno weave pattern, wherein the leno woven fabric comprises a first portion and a second portion; and an inflatable bladder disposed only on the leno woven fabric at the first portion, wherein the first portion of the leno woven fabric comprises a first leno weave pattern comprising a first degree of stretchability, and the second portion of the leno woven fabric comprises a second leno weave pattern comprising a second degree of stretchability greater than the first degree of stretchability.

11. The upper of claim 10, wherein the leno woven fabric extends across an entire length of the upper.

12. The upper of claim 10, wherein the leno woven fabric extends across an entire width of the upper.

13. The upper of claim 10, wherein the inflatable bladder is disposed on an outside of the leno woven fabric.

14. The upper of claim 10, wherein the inflatable bladder is disposed on an underside of the leno woven fabric.

15. The upper of claim 10, wherein the leno woven fabric comprises a single layer that forms a portion of an exterior surface of the upper and a portion of an interior surface of the upper.

16. The upper of claim 10, wherein the leno woven fabric comprises an outermost layer of the upper and an innermost layer of the upper.

17. The upper of claim 10, wherein the inflatable bladder is adhered to the leno woven fabric with an adhesive.

18. The upper of claim 17, wherein the adhesive comprises a hot melt adhesive.

19. The upper of claim 10, wherein the first leno weave pattern varies from the second leno weave pattern.

20. An article of footwear comprising:

a sole;

an upper comprising a leno woven fabric having a continuous leno weave pattern, wherein the leno woven fabric comprises a first portion and a second portion; and an inflatable bladder disposed only on the leno woven fabric at the first portion, wherein the first portion of the leno woven fabric comprises a first leno weave pattern comprising a first degree of stretchability, and the second portion of the leno woven fabric comprises a second leno weave pattern comprising a second degree of stretchability greater than the first degree of stretchability.

21. The article of footwear of claim 20, wherein the leno woven fabric comprises an outermost layer of the upper and an innermost layer of the upper.

22. The article of footwear of claim 20, wherein the leno woven fabric comprises an elastic material.

23. The article of footwear of claim 20, wherein the first leno weave pattern varies from the second leno weave pattern.

* * * * *